US008820564B2

(12) United States Patent
Fuglie et al.

(10) Patent No.: US 8,820,564 B2
(45) Date of Patent: Sep. 2, 2014

(54) CONTAINER LID WITH T-SHAPED OPENING

(71) Applicants: Robert J. Fuglie, Chanhassen, MN (US); Kenneth V. Schomburg, Plymouth, MN (US)

(72) Inventors: Robert J. Fuglie, Chanhassen, MN (US); Kenneth V. Schomburg, Plymouth, MN (US)

(73) Assignee: Square Jug Design, LLC, Chanhassen, MN (US)

( * ) Notice: Subject to any disclaimer, the term of this patent is extended or adjusted under 35 U.S.C. 154(b) by 0 days.

(21) Appl. No.: 13/691,295

(22) Filed: Nov. 30, 2012

(65) Prior Publication Data

US 2013/0134176 A1 May 30, 2013

Related U.S. Application Data

(60) Provisional application No. 61/565,258, filed on Nov. 30, 2011.

(51) Int. Cl.

| | |
|---|---|
| ***B65D 43/16*** | (2006.01) |
| ***B65D 47/12*** | (2006.01) |
| ***B65D 25/48*** | (2006.01) |

(52) U.S. Cl.

CPC ..... *B65D 43/163* (2013.01); *B65D 47/122* (2013.01); *B65D 43/16* (2013.01); *B65D 25/48* (2013.01)

USPC ..... 220/259.1; 220/256.1; 222/568; 215/243

(58) Field of Classification Search

CPC .... B65D 43/163; B65D 43/16; B65D 47/122; B65D 47/12; B65D 47/06; B65D 25/48; B65D 25/40

USPC ..... 220/254.3, 254.1, 259.1, 256.1, 844, 220/843, 836, 848, 810, 367.1; 215/228, 215/243, 237, 235; 222/562, 556, 547, 545, 222/544, 568, 567, 566

See application file for complete search history.

(56) References Cited

U.S. PATENT DOCUMENTS

| | | | | |
|---|---|---|---|---|
| 2,886,218 | A * | 5/1959 | Marcus | 222/517 |
| D331,877 | S * | 12/1992 | Robichaud et al. | D9/449 |
| 5,499,736 | A * | 3/1996 | Kohl | 220/254.5 |
| 6,510,971 | B1 * | 1/2003 | Martin | 222/556 |
| 6,830,721 | B2 * | 12/2004 | Martin | 264/318 |
| 7,028,863 | B1 * | 4/2006 | Taylor | 222/83 |
| D614,488 | S * | 4/2010 | Kallenbach et al. | D9/449 |
| 2013/0008926 | A1 * | 1/2013 | Bell | 222/568 |

* cited by examiner

*Primary Examiner* — Robert J Hicks

(74) *Attorney, Agent, or Firm* — Brooks, Cameron & Huebsch, PLLC

(57) ABSTRACT

One container lid embodiment includes a body and a cap pivotably attached to the body via a hinge assembly. The body has internal threads configured to engage external threads on a fluid port of the container. The body has an opening corresponding to less than all of an area of the fluid port. The opening, configured as a modified teardrop opening through the body, includes an arc portion adjacent a circumference of the body opposite the hinge in fluid cooperation with an elongate vent extending perpendicularly from the arc portion towards the hinge. The body has a lip adjacent to the arc portion of the opening, extending radially away from the opening. The cap is configured to seal the body when articulated in proximity with the body.

8 Claims, 4 Drawing Sheets

CONTAINER LID WITH T-SHAPED OPENING

BACKGROUND

The present disclosure is generally related to the field of sealable fluid containers, and more particularly, to a fluid container lid.

Storage containers for fluids have been part of our daily lives for many decades. As used herein, the term "fluid storage container" applies to containers used to store fluids which are commonly found and dispensed in the home and in commercial environments. For purposes of the present disclosure the term "fluid", as used herein, connotes liquids, powders, and any other type of material that can be poured out of a container and wherein an embodiment of the present disclosure would be of benefit, such as milk, water, paints, oil, antifreeze, windshield washer fluid, household fluids, etc.

DETAILED DESCRIPTION

The present disclosure includes devices and systems for a container lid. One container lid embodiment includes a body and a cap pivotably attached to the body via a hinge assembly.

The body has internal threads configured to engage external threads on a fluid port of the container. The body has an opening corresponding to less than all of an area of the fluid port.

The opening, configured as a modified teardrop opening through the body, includes an arc portion adjacent a circumference of the body opposite the hinge in fluid cooperation with an elongate vent extending perpendicularly from the arc portion towards the hinge. The body has a lip adjacent to the arc portion of the opening, extending outward from the opening. The cap is configured to seal the body when articulated in proximity with the body.

In the following detailed description of the present disclosure, reference is made to the accompanying drawings that form a part hereof, and in which is shown by way of illustration how one or more embodiments of the disclosure may be practiced. These embodiments are described in sufficient detail to enable those of ordinary skill in the art to practice the embodiments of this disclosure, and it is to be understood that other embodiments may be utilized and that process, electrical, and/or structural changes may be made without departing from the scope of the present disclosure.

Containers can be made of glass, metal, plastic or other materials. One fluid storage container, for example, can be milk jug.

A typical milk jug container can come in a gallon size and can have a re-sealable opening in the container through which the fluid (e.g., milk) can be poured. Howevever, embodiments of the container lid of the present disclosure are not limited to those for a milk jug, and can be configured to be used on other types of fluid containers.

The opening in the container is referred to herein as a fluid port. Some containers have a fluid port that utilizes a cap that snaps onto the fluid port. Other containers can have a threaded fluid port that utilizes a cap with opposing threads, which can be screwed onto the fluid port to re-seal the fluid port after opening.

Some fluid storage containers have a fluid port and a separate opening as a vent, and some storage containers have only a fluid port and no separate vent. That is, the fluid port can also need to function as a vent when fluids are being drained from the container. The fluid port is often larger than a vent, if any, and may be used for filling the fluid storage container and/or draining fluid out of the fluid storage container.

A vent can allow air to be displaced as fluid flows into or out of the fluid storage container. In some implementations, the vent may also be sealable to contain the fluid and, in some arrangements, the fluid vapors within the fluid storage container.

Figure 1A:
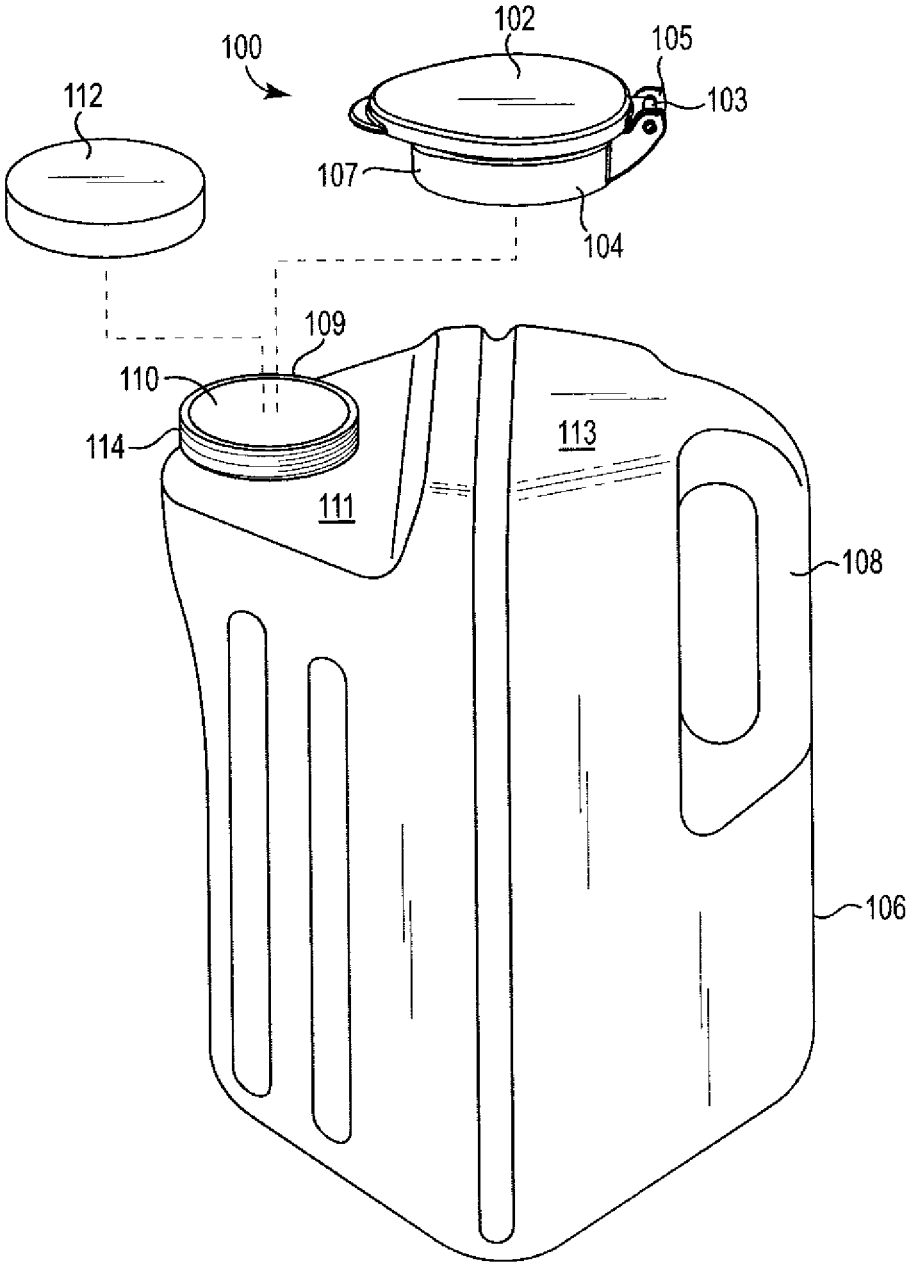
FIG. 1A is a perspective view of an example of a container lid according to an example embodiment of the present disclosure.

FIG. 1A is a perspective view of an example of a container lid 100 according to an example embodiment of the present disclosure. FIG. 1A shows a container 106 for storing fluids. The container 106 can have a handle 108 and a fluid port 110 (e.g., opening).

The container 106 can generally be square shaped, as is shown in FIG. 1A. For example, the container 106 can be a substantially squared milk jug used by dairies and/or retail grocery stores such as a COSTCO® milk jug. However, embodiments of the present disclosure are not limited to any particular container shape, volume, and/or configuration.

In some arrangements, the fluid port 110 is located in an opposite corner from the handle 108, an arrangement that facilitates fluid flowing to the fluid port 110 when the handle 108 is lifted. The fluid port 110 can have a spout 109. The container 106 can have a top surface 113 and a recessed top surface 111. The spout 109 can be located protruding upwards from the recessed top surface 111 a distance that does not exceed the height of the top surface 113.

The spout 109 can have external threads 114. The fluid port 110 may be initially sealed by a screw-on closure 112. The screw-on closure 112 can have internal threads that engage with the external threads 114 of the spout 109. The spout 109 can protrude upwards from the recessed top surface 111 such that a top surface of the screw-on closure 112, where the screw-on closure 112 is fully engaged with (e.g., screwed-on tight) the spout 109, is at a same level as the top surface 113, which can facilitate stability in stacking of multiple containers 106 atop one another.

FIG. 1A shows the container lid 100 comprising a cap 102 and a body 104. The cap 102 can be pivotably attached to the body 104, such as by a hinge assembly.

The hinge assembly can comprise a pivot rod 103 engaged between two hinge plates 105. The cap 102 can have the pivot rod 103 attached thereto. The body 104 can have a circular sidewall 107, and the sidewall can have two hinge plates 105 attached thereto.

Male ends of the pivot rod 103 can fit into corresponding recesses (e.g., holes) in the hinge plates 105 such that the pivot rod can rotate therein as the cap 102 is rotated away from the body 104 in an articulated motion. The cap 102 can be configured to seal the body 104 when articulated in proximity with the body 104, or swing away from the body 104 to allow fluid through the body 104, such as during pouring.

Figure 1B:
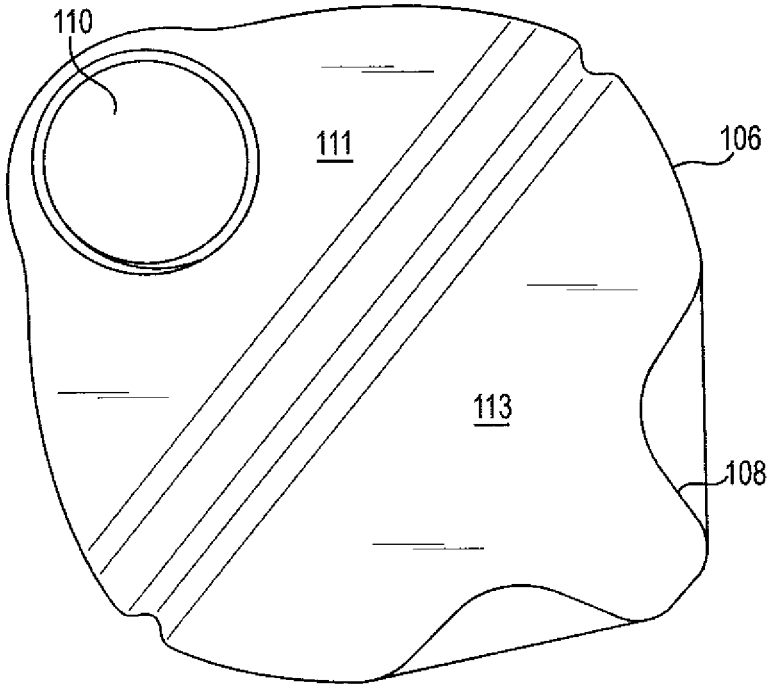
Fig. 1B (PRIOR ART)
FIG. 1B is a top view of a container of the prior art.

FIG. 1B is a top view of a container 106 of the prior art. FIG. 1B shows the orientations of the top surface 113, the recessed top surface 111, and the location of the fluid port 110 opposite the handle 108. The fluid port 110 can be round so as to enable mating with the screw-on closure 112 and/or container lid 100.

Figure 2:
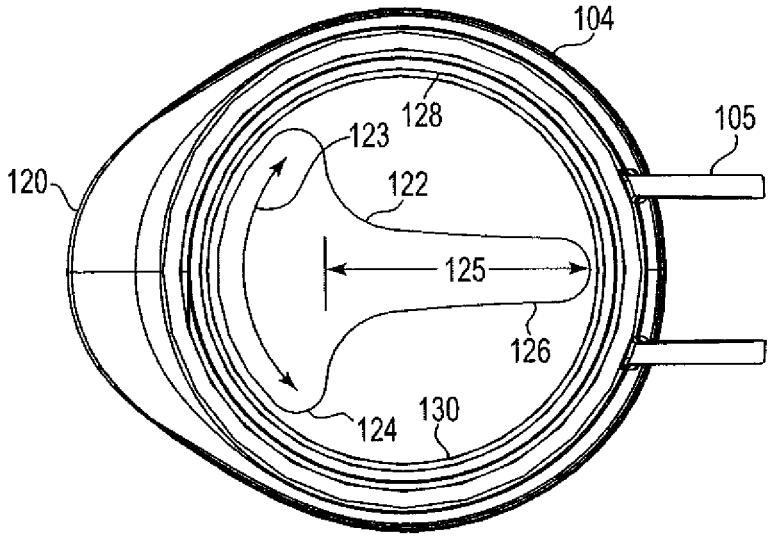
FIG. 2 is a bottom view of a body of a container lid according to an example embodiment of the present disclosure.

FIG. 2 is a bottom view of a body 104 of a container lid according to an example embodiment of the present disclosure, such as viewing the body 104, as seen in FIG. 1A, from below and without the lid 102 attached thereto.

The body 104 can have an opening 122 corresponding to less than all of an area of the fluid port. That is, the opening 122 can be configured to block some flow through the fluid port 110 of the container 106 when the body is secured in place (e.g., screwed-on).

The opening 122 can be configured as rounded "T" or a modified teardrop opening through the body, which is one configuration having the above-mentioned characteristics. The opening 122 can include an arc portion 124 extending a distance 123 in a radial direction from a circumference of the body opposite the hinge assembly (e.g. hinge plates) in fluid cooperation, the arc portion 124 corresponding to the horizontal portion of a rounded "T" shape.

The opening 122 can further include an elongate vent 126. The elongate vent 126 corresponds to the vertical stroke of a rounded "T" shape.

The elongate vent 126 can be configured and/or oriented to allow air to be displaced as fluid flows into or out of the fluid storage container. The elongate vent 126 can extend a distance 125 oriented perpendicularly from the arc portion towards the hinge. That is, the elongate vent 126 can extend in a radial direction towards the center of the body 104 from an arc about the circumference of the body opposite the hinge assembly. The elongate vent 126 can be narrower than the arc portion 124.

The elongate vent 126 can be configured to extend beyond the center of the body 104, for example, to be in proximity with an inner edge 130 of the circular sidewall 107. According to various embodiments, the elongate vent 126 extends from the arc portion 124 to inner edge 130 of the circular sidewall 107 located between the hinge plates. According to some embodiments, the elongate vent 126 is arranged and configured within the opening 122 through the body 104 such that fluid doesn't "glug" (i.e., alternating conditions of liquid flowing through the entire opening and air flowing through the opening so as to result in unsmooth fluid flow) for some angular range of container orientation away from a vertical orientation when fluid is being poured therefrom.

The body can have a lip 120 adjacent to the arc portion 124 of the opening. The lip 120 can extend in a radial direction away from the circular sidewall 107 near the arc portion 124 of the opening 122. The lip 120 can have a partial cone shape, thus serving as a spout for the body 104 to channel fluid toward a center of the lip 120, for example, the center of the lip 120 being opposite a center location between the hinge plates 105.

The lip 120 can be configured to prevent dripping of fluid down the outside of the circular sidewall 107 by adhesive fluid flow. In some embodiments, the lip 120 can be sized to extend laterally at least to the edge (e.g., outermost dimension) of the container 106 to which the body 104 is attached (e.g., screwed-on). In other embodiments, the lip 120 can be sized to extend laterally beyond the edge of the container 106 to which the body 104 is attached. That is, the lip 120 can extend laterally slightly beyond the corner of a substantially squared container.

The distance to which the lip 120 extends can depend on the configuration and dimensions of the container 106, as well as a location of the fluid port 110 on the container 106. The lip 120 can be arranged and configured to mitigate adhesive fluid flow down a side of the container 106 and drips during intended fluid flow.

The body 104 can have internal threads 128 configured to engage external threads 114 on the fluid port 110 of the container 106 (e.g., in a similar manner as does the screw-on closure 112). The internal threads 128 can be arranged such that the lip 120 is oriented towards an edge (e.g., a nearest edge or edge at a nearest corner) of the container 106 when the body is fully engaged on the fluid port 110, such as when the internal threads 128 are fully engaged with the external threads 114. According to various examples, the lip 120 is oriented towards a corner of the container 106 that is furthest away from the handle 108 when the body 104 is fully engaged on the fluid port 110.

Figure 3:
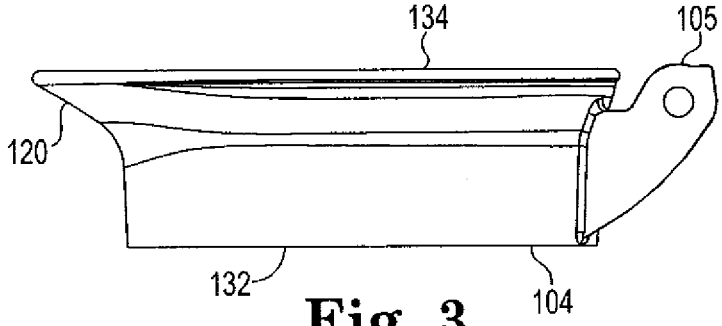
FIG. 3 is a side view of a body of a container lid according to an example embodiment of the present disclosure.

FIG. 3 is a side view of a body 104 of the container lid 100 shown in FIG. 1A according to an example embodiment of the present disclosure. The body 104 can have a bottom end 132 and a top end 134. The opening 122 allows fluid to pass through the body 104 between the bottom end 132 and the top end 134.

FIG. 3 shows the partial cone shape of the lip 120, as well as the opposing locations along the exterior of the body 104 of the lip 120 and the hinge plates 105. The lip 120 can be located opposite the hinge assembly such that fluid is poured out away from the cap 102 when it is in a position articulated away from the body 104 about the hinge assembly.

Figure 4:
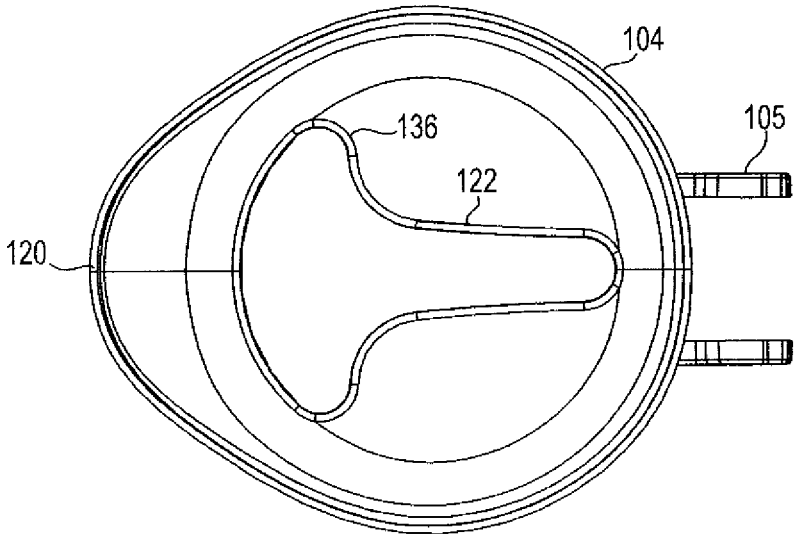
FIG. 4 is a top view of a body of a container lid according to an example embodiment of the present disclosure.

FIG. 4 is a top view of a body 104 of a container lid 100 according to an example embodiment of the present disclosure. FIG. 4 illustrates a view of a body 104 from the perspective of looking into the top end 134. The orientation and configuration of the lip 120 opposite the hinge plates 105 can be observed. The opening 122 is shown having a ridge 136 around the circumference to prevent adhesion flow away from the opening (e.g., away from the lip 120).

Figure 5:
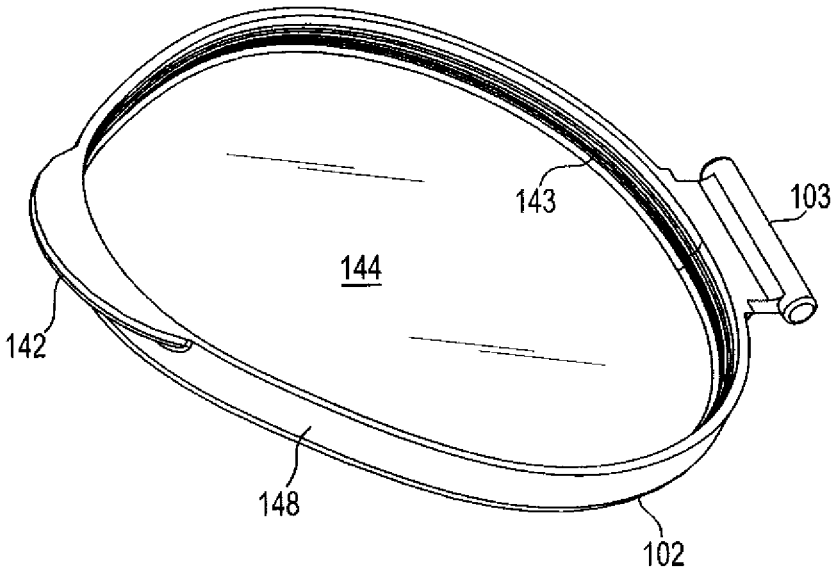
FIG. 5 is an inside perspective view of a cap of a container lid according to an example embodiment of the present disclosure.

FIG. 5 is an inside perspective view of a cap 102 of a container lid 100 shown in FIG. 1A according to an example embodiment of the present disclosure. The cap 102 can be pivotably attached to the body 104, and configured to seal the body 104 opposite the fluid port when articulated in close proximity with the body 104. For example, the cap 102 can seal the body around the top end 134 of the body 104, as can be seen in FIG. 3, and/or around some portion of the circular sidewall 107, shown in FIG. 1A.

The cap 102 can have a pivot rod 103 attached thereto. The cap 102 can have an interior sealing surface 144. A sidewall 148 can extend around the perimeter of the interior sealing surface 144. The sidewall 148 can be configured to extend down around a portion of the sidewall 107 of the body 104, and sized with one or more friction features 143 (e.g., ridges) so as to achieve a friction fit in order to seal the body 104.

For example, the friction features 143 can help seal the cap 102 to the body 104 with such a gripping force that fluid can be held within the container when partially and/or fully inverted. For example, the cap 102 may be fabricated of a material having capability to deform (e.g., stretch) and return to an original shape, and/or fabricated to have dimensions slightly less than the dimensions of the corresponding body 104, such that the cap can be deformed to fit around the body 104 with a tight grip due to material stretching.

The interior sealing surface 144 can have a "teardrop" or egg shape, as shown in FIG. 5. According to various embodiments, the teardrop/egg shape can correspond to the shape of the top end 134 of the body 104, including the lip 120. In this manner, the cap 102 can seal the opening 122 and contain any fluid outside the opening 122 but within surfaces of the body 104, including the lip 120. The pivot rod 103 and the tab 142 can be attached at opposite ends across a widest diameter, with the tab 142 being attached at the pointier side of the teardrop/egg shape, as shown in FIG. 5.

A tab 142 can extend radially away from the sidewall 148 around a portion of the perimeter of the interior sealing surface 144. The tab 142 can be oriented perpendicular to the sidewall 148 in some embodiments. The tab 142 can be configured, in size, location, and strength such that force can be exerted to pivot the cap 102 about the hinge assembly (e.g., around the pivot rod 103), including to overcome any frictional force the cap 102 exerts upon the body 104.

According to various examples, the tab 142 can be located on the cap 102 opposite the pivot rod 103 in order to provide a location to achieve a maximum leverage about the pivot rod 103. In some implementations, the cap 102 can be configured seal the body 104 so as to contain fluid and fluid vapors within the fluid storage container 106.

Figure 6:
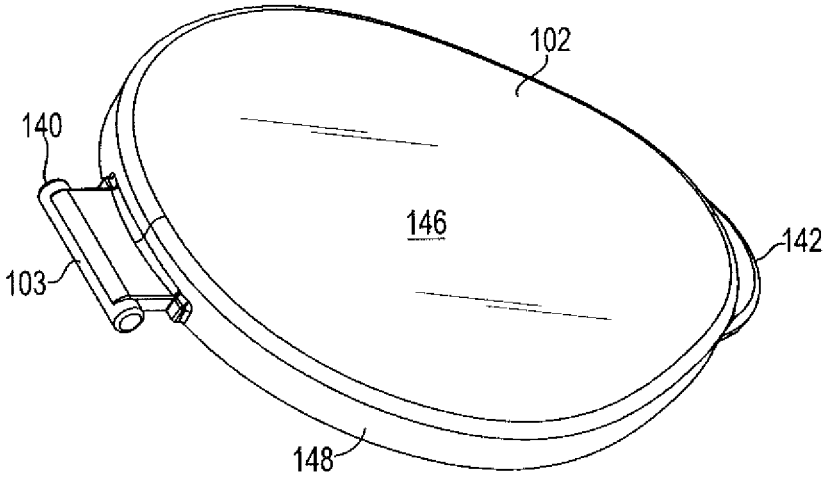
FIG. 6 is an outside perspective view of a cap of a container lid according to an example embodiment of the present disclosure.

FIG. 6 is an outside perspective view of a cap of a container lid according to an example embodiment of the present disclosure. FIG. 6 illustrates the pivot rod 103 attached thereto, the pivot rod including a male or female end for engaging the hinge plates 105 and corresponding to corresponding features therein.

The cap 102 can have an exterior (e.g., top) surface 146 opposing the interior surface 144. Additional aspects concerning the location and configuration of the sidewall 148 and tab 142 can be seen in FIG. 6.

According to various embodiments, the pivot rod 103 and hinge plates 105 have a friction fit loose enough that the cap can be moved by application of human interaction but with sufficient friction such that the cap does not tend to move by gravitational forces without human interaction (e.g., cap stays open during fluid pouring). According to some embodiments, the hinge assembly can have detents at certain radial positions to aid in retaining the cap 102 in a particular radial position (e.g., at 45 degrees open where 0 degrees corresponds to the cap being closed onto the body 104).

According to some embodiments, the body 104 and cap 102 are sized so as not to increase a profile of the container 106 beyond the top surface 113 when the container lid 100 is fully engaged on the fluid port 110.

The body and/or cap may be formed of any suitable material, including plastics such as polypropylene.

Some of the benefits of the embodiments of the present disclosure include, but are not limited to the body 104 and cap 102 being integrated as a unit through the hinge assembly such that the container lid 100 can be stored together and washed in a dishwasher as a single unit so as to prevent loss of the body 104 and cap 102.

Although specific embodiments have been illustrated and described herein, those of ordinary skill in the art will appreciate that any arrangement calculated to achieve the same function and beneficial attributes can be substituted for the specific embodiments shown. This disclosure is intended to cover any and all adaptations or variations of various embodiments of the disclosure.

As used herein, the term "and/or" includes any and all combinations of one or more of the associated listed items. It will be understood that, although the terms first, second, etc. may be used herein to describe various elements and that these elements should not be limited by these terms. These terms are only used to distinguish one element from another element. Thus, a first element could be termed a second element without departing from the teachings of the present disclosure.

It is to be understood that the use of the terms "an", "one or more", "a number of", or "at least one" are all to be interpreted as meaning one or more of an item is present. Additionally, it is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

What is claimed is:

1. An apparatus, comprising:

a body having a mating surface cooperative with a fluid port of a container, the body having an opening therethrough configured as a rounded T-shaped opening, the opening corresponding to less than all of an area of the fluid port; and a cap pivotably attached to the body, the cap configured to seal the body when articulated in proximity with the body, wherein the rounded T-shaped opening includes an arc portion, the arc portion being in fluid cooperation with an elongate vent, that is narrower than the arc portion, and wherein the arc portion includes two sections that each extend outward from one end of the elongate vent.

2. An apparatus, comprising:

a body having a mating surface cooperative with a fluid port of a container, the body having a top surface with an opening therethrough configured as a rounded T-shaped opening, the opening corresponding to less than all of an area of the fluid port;

an outer edge top surface of the body, wherein a portion of the outer edge has a first edge radius and a lip along a portion of the outer edge extending from the first edge radius to a second edge radius of the top surface of the body, wherein the second edge radius is greater than the first edge radius of the top surface; and wherein the rounded T-shaped opening includes an arc portion located adjacent a circumference of an inner edge of a circular sidewall of the body, the arc portion being in fluid cooperation with an elongate vent, that is narrower than the arc portion, extending toward a center of the top surface of the body, and wherein the T-shaped opening has an edge that forms the opening in the top surface and wherein a ridge is oriented along at least a portion of the edge of the opening.

3. An apparatus, comprising:

a body having a mating surface cooperative with a fluid port of a container, the body having a top surface with an opening therethrough configured as a rounded T-shaped opening;

a first portion of an outer edge of the top surface having a first edge radius and a second portion of the outer edge of the top surface forming a lip extending from the first edge radius to a second edge radius of the top surface, wherein the second edge radius is greater than the first edge radius; and wherein the rounded T-shaped opening has a first elongate vent portion extending in a radial direction toward the center of the top surface and a second elongate arcuate section of the T-shaped opening having portions extending outward from a first end of the elongate vent portion and wherein the T-shaped opening is oriented to direct fluid through at least one or more of the outward extending portions of the second elongate arcuate section of the T-shaped opening and toward the lip.

4. The apparatus of claim 3, wherein one end of each of the portions of the second elongate arcuate section is perpendicular to the elongate vent portion.

5. The apparatus of claim 3, wherein an outer surface of the second elongate arcuate section has an arcuate shape that follows shape of the first radius.

6. The apparatus of claim 3, wherein the first elongate vent portion extends through the center of the top surface.

7. The apparatus of claim 3, wherein the apparatus includes a hinge mechanism for mounting a cap to the body.

8. The apparatus of claim 7, wherein a cap is mounted to the hinge mechanism via a pivot rod and wherein the hinge mechanism has detents at one or more radial positions to aid in retaining the cap in one or more particular radial positions with respect to the location of the pivot rod.

* * * * *